United States Patent [19]

Gasloli

[11] 4,351,288

[45] Sep. 28, 1982

[54] OVEN DOOR LATCH

[75] Inventor: Joseph L. Gasloli, Kentwood, Mich.

[73] Assignee: White Consolidated Industries, Inc., Cleveland, Ohio

[21] Appl. No.: 274,525

[22] Filed: Jun. 17, 1981

[51] Int. Cl.[3] ..... E05B 63/20

[52] U.S. Cl. ..... 126/197; 292/333; 292/113; 292/106; 126/192

[58] Field of Search ..... 126/197, 192; 292/333, 292/106, 109, 113

[56] References Cited

U.S. PATENT DOCUMENTS

| | | | |
|---|---|---|---|
| 1,934,105 | 11/1933 | Totty | 292/333 |
| 2,001,443 | 5/1965 | Williams | 292/333 |
| 3,438,666 | 4/1969 | Erickson | 292/113 |
| 3,831,580 | 8/1974 | McLean | 126/197 |
| 4,133,337 | 1/1979 | Shea | 126/197 |

*Primary Examiner*—Samuel Scott
*Assistant Examiner*—G. Anderson
*Attorney, Agent, or Firm*—Pearne, Gordon, Sessions, McCoy & Granger

[57] ABSTRACT

A mechanism for inhibiting the locking movement of a hooklike oven door latch member when an associated keeper fixed to the oven door is not in its proper position for engagement with the latch member. Inhibiting the locking movement of the latch member precludes the closing of associated interlock switches to prevent the user from initiating a high temperature oven cleaning cycle or a microwave cooking cycle without proper locking of the oven door. The mechanism includes a stop member biased at a latch movement inhibiting position, the stop member being moved to a non-inhibiting position by engagement with the keeper when the oven door is moved to a fully closed position.

2 Claims, 6 Drawing Figures

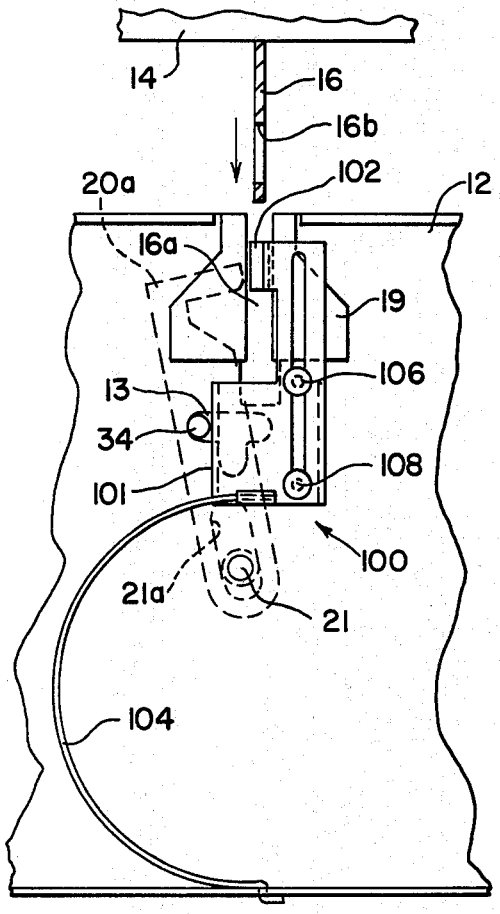
FIG. 4
FIG. 5
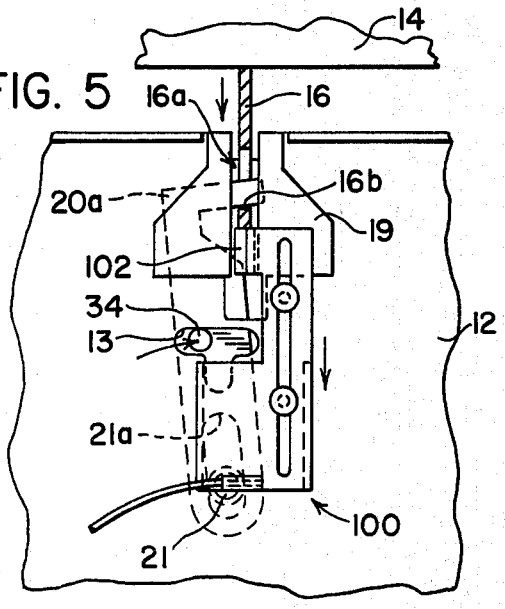
FIG. 6
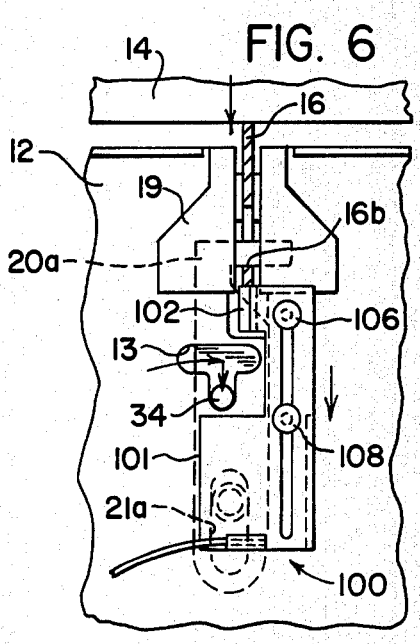

OVEN DOOR LATCH

BACKGROUND OF THE INVENTION

The present invention relates in general to a latch for lockably retaining a door in a fully closed position, and in particular to a mechanism for inhibiting the locking movement of the latch when the door is not properly positioned to effect its locking.

The invention finds particular use as a safety device for a domestic range having a self-cleaning oven of the pyrolytic type. Such a range may also include a microwave energy source for irradiating food placed in the oven cavity that typically contains conventional resistance heating elements. This "common cavity" type oven enables a user to cook food therein with microwave energy only or with conventional resistance heating only, or with a combination of both. Also, the resistance heating elements can be used to highly heat the oven cavity to effect a pyrolytic cleaning action of the walls thereof.

It is imperative for recognized safety reasons that an associated oven door remain locked in a fully closed position during periods of microwave irradiation in the oven or during a high temperature pyrolytic oven cleaning cycle. While a microwave energy source can quickly be disabled by microswitches sensing the unlocking of the door, thus avoiding an unsafe "open-door" operating condition, the pyrolytic cleaning action of a highly heated oven cannot be so readily terminated. Thus, it is further necessary to prevent the unlocking of the oven door by the user during the period of time that the oven cavity is at a pyrolytic cleaning temperature, since premature unlocking and opening of the door could expose the user to very high temperature pyrolytic-induced oven gases and could also result in an explosion of such gases if they are combustible, as is often the case when a very dirty oven is being pyrolytically cleaned.

In view of the above safety requirements, it is known to provide such a "common cavity" type self-cleaning oven with a three-position, manually actuated oven door latch mechanism. At a first or unlocked position, the latch mechanism permits free opening and closing of the oven door for conventional baking and broiling within the oven. At a second or microwave position, the latch mechanism locks the door at a closed position during a microwave cooking cycle, the user being able at any time to move the latch mechanism from its second to its first position to terminate the microwave cooking cycle and unlock and open the oven door. A plurality of interlock-type microswitches actuated by the latch mechanism only at its second position enable the microwave circuitry. At a third or pyrolytic cleaning position, the latch mechanism locks the oven door in a closed position. Further, another interlock-type microswitch, only responsive to the movement of the door latch to its third position, enables the self-cleaning circuitry to energize the oven heating elements. Further, a temperature-controlled retaining mechanism prevents unlocking of the oven door by the user when the oven temperature is at a pyrolytic or near pyrolytic level.

It can be seen that the various interlock switches are responsive to movement of the latch mechanism and not to movement of the oven door itself. It thus becomes absolutely necessary to ensure that the latch mechanism cannot be moved to a locked position, i.e., its second or third position, without its proper engagement with the oven door. In other words, a fail-safe device must be provided to ensure that a user cannot inadvertently energize the range into a microwave or self-cleaning cycle without proper locking of the oven door at its closed position.

SUMMARY OF THE INVENTION

The present invention provides a mechanism for inhibiting the locking movement of a hooklike oven door latch member engageable with a keeper fixed to an associated oven door, the latch member being movable toward the keeper and lockably engageable with it only when the oven door is fully closed. The inhibiting mechanism includes a stop member movable between at least two positions. At one position, when the oven door is open, the stop member blocks and interferes with the movement of the latch member toward the location of the keeper at its closed oven door position. When the over door is moved to its closed position, the keeper moves the stop member towards its other position into a non-blocking and non-interfering position relative to the latch member locking movement. The latch member is then free to move toward and lockably engage the keeper on the oven door.

In a preferred form, the inhibiting mechanism includes a spring-biased linear slide stop that blocks a slot in which a pin fixed to the latch member rides.

The invention advantageously provides in a simple and low cost manner a fail-safe device to preclude operation of the oven in an unsafe manner.

BRIEF DESCRIPTION OF THE DRAWINGS

A fuller understanding of the invention may be had by referring to the following description and claims taken in conjunction with the accompanying drawings, wherein:

FIGS. 4, 5, and 6 are plan views of a latch inhibiting mechanism in accordance with the present invention, in association with an oven door keeper at various engagement positions relative to the inhibiting mechanism.

DETAILED DESCRIPTION OF THE PREFERRED EMBODIMENT

Figures 1, 1A, 1B:
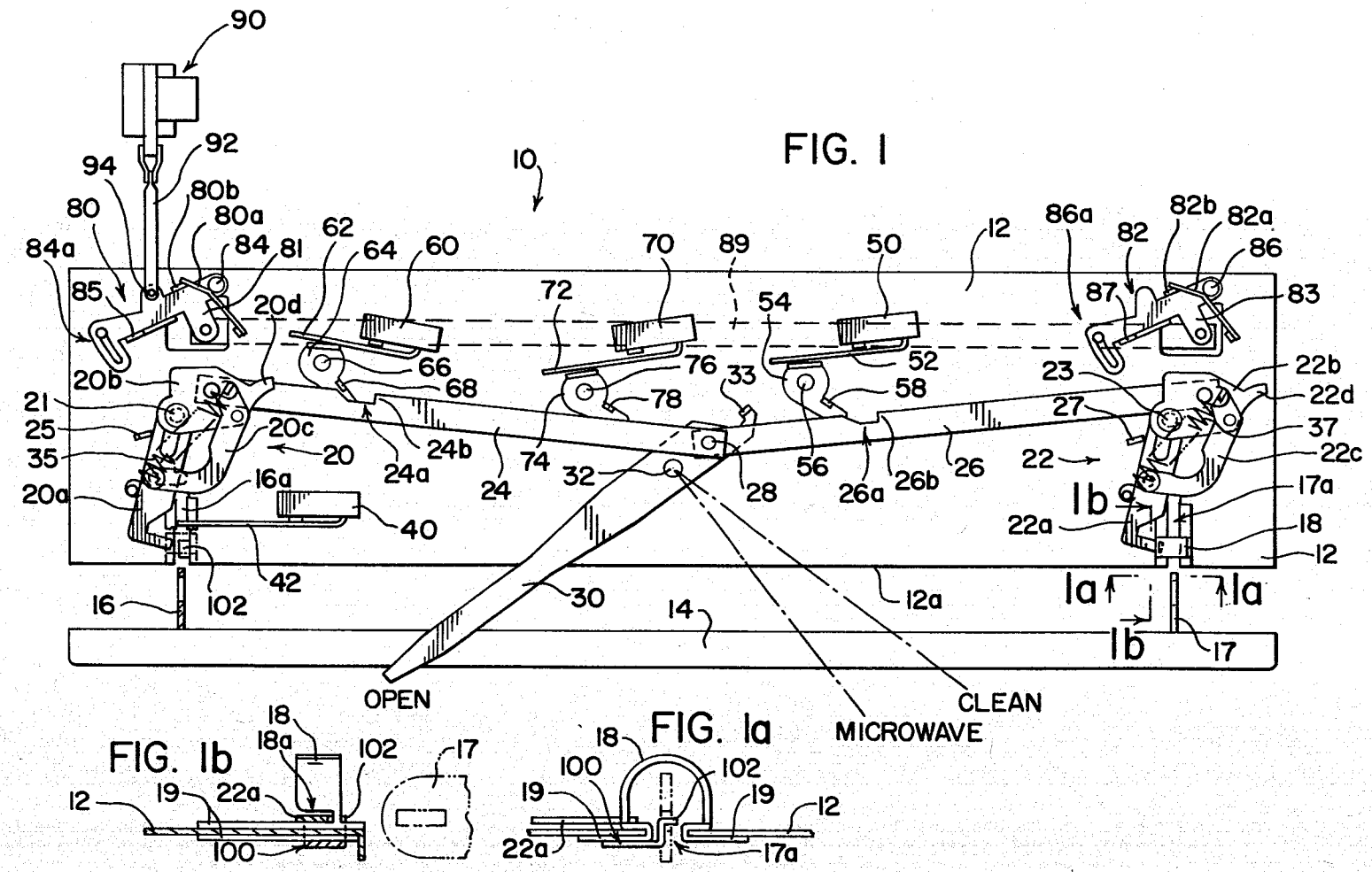
FIG. 1 is a plan view of an oven door latching and locking mechanism incorporating the present invention, the latching and locking mechanism being in an "open" condition for normal baking and broiling within an associated oven.
FIGS. 1*a* and 1*b* are elevational views of an oven door lift stop structure illustrated in FIG. 1.

With reference to FIG. 1, there is illustrated a three-position, manually actuated oven door latching and locking mechanism 10 in an opened, non-latched condition. As viewed in plan, the mechanism 10 includes a supporting superstructure or frame 12 preferably constituted by a formed metal plate fixed to a conventional domestic range body (not shown) in a position parallel to and adjacent to the top edge 14 of a bottom-hinged oven door of conventional design for closing the outwardly opening face of an oven cavity provided within the range body. The left side (as viewed in FIG. 1) of the upper edge 14 of the oven door provides a first bladelike keeper 16 (shown in cross section) fixed to the door and extending perpendicularly outward from its inner face, the keeper 16 being eyeletlike for engagement with a hooklike latch mechanism, to be subsequently discussed. In a like fashion, the right side of the oven door upper edge 14 includes a second bladelike keeper 17 fixed to the door. The upper edge 14 of the door, which is hinged at its bottom, swings in arcuate fashion to and away from the latching and locking mechanism 10, which is capable of lockably retaining the door when manually actuated by the range user to a "microwave" position or a "clean" position, as noted in FIG. 1.

As the oven door upper edge 14 moves toward a closed position, the keepers 16,17 will be received into keeper-receiver slots or channels 16*a*, 17*a* provided along the forward edge 12*a* of the frame 12. Mounted on the upper side of the frame 12 are a pair of spring-loaded latch mechanisms 20, 22 having portions engageable with the keepers 16,17 when they are properly positioned within their respective channels 16*a*, 17*a*. The latch mechanisms 20,22 include reciprocating hook members 20*a*,20*a* that pivot about and slide to a limited degree upon a fixed pivot pin 21,23 fixed to the frame 12. Also pivotal on and about the pins 21,23 are a respective pair of lever members 20*b*, 22*b* which are connected to the hook members 20*a*, 22*a* via connecting links 20*c*, 22*c*.

It can be seen that counterclockwise rotation of the lever members 20*b*, 22*b* about their respective pivot pins 21,23 will cause the hook members 20*a*, 22*a* to move towards and into the channels 16*a*, 17*a* for engagement with the keepers 16,17 when positioned therein. Further, the hook members 20*a*, 20*b*, after initial engagement with the keepers 16,17, will pull back into or, as viewed in FIG. 1, move upwardly and slide on the pins 21,23 to tightly pull the oven door into sealing engagement with conventional peripheral seals about the open face of the oven cavity (not shown). To effect counterclockwise rotation of the lever members 20*b*, 22*b*, a pair of latch actuating links 24, 26 extends from the lever members 20*b*, 22*b* to a common latch link pin joint 28 provided at one end of a leverlike latch actuating handle 30 fulcrummed at a pivot joint 32 fixed in position on the frame 12, manual movement of the handle 30 to the right as illustrated in FIG. 1 causing counterclockwise revolution of the lever members 20*b*, 22*b*. It is to be noted that both spring-loaded latch mechanisms 20, 22 (when in an open condition) are biased by appropriate springs 35,37 in clockwise rotation towards appropriate tab-type stops 25,27 provided by the frame member 12. The biasing springs 35,37 also act to tightly snap the oven door into sealing engagement with the above-noted door seal once the latch mechanisms 20,22 reach an oven-center condition.

It is noted that the general design and actuating movement of the latch mechanisms 20,22 are similar to and based upon the design of the mechanism disclosed in U.S. Pat. No. 4,133,337, which is incorporated by reference herein in its entirety.

In order to ensure safe operation of an associated "common cavity" oven (one having both microwave and conventional cooking capability with pyrolytic self-cleaning, as discussed earlier), the oven door latching and locking mechanism 10 includes a door monitor microswitch 40 having a switch actuating arm 42 extending outwardly into the channel 16*a* for engagement with a keeper 16 as it moves into the channel 16*a*. The mechanism 10 also includes a primary microwave cooking interlock switch 50, a secondary microwave cooking interlock switch 60, and a self-clean enable switch 70, all three switches 50,60,70 being of the microswitch-type with appropriate switch actuating arms 52,62,72. The arms 52,62,72 are moved in leverlike fashion to actuate and deactuate the associated switches 50,60,70 by generally identical rotatable toggle elements 54,64,74 rotatable on respective pins 56,66,76. Extended arm portions of the toggles 54,64,74 provide respective cam follower tabs 58,68,78 that engage with the door actuating linkage members 24,26 and the handle 30 under various operating positions of the mechanism 10.

With particular reference to the primary interlock switch 50, there is provided in the latch actuating link 26 a notch 26*a* having a shoulder 26*b*, such notch and shoulder acting as a cam for engagement with the cam followerlike tab 58 as the link 26 moves towards the left as the handle 30 is moved towards the right. Likewise, the link member 24 includes a notch 24*a* and a shoulder 24*b* that engage with the cam followerlike tab 68 as the link 24 moves leftwardly upon a closing motion of latch mechanisms 20,22. Finally, the self-clean enable switch 70 is actuated and deactuated by engagement and disengagement with a switch actuating projection 33 at the inner end of the handle 30. The operating sequence and function of switches 40,50,60,70 will be discussed subsequently with regard to FIGS. 2 and 3.

The oven door latching and locking mechanism 10 also includes a pair of movable stops 80,82 rotatable on respective pins 84,86 fixed to the frame 12. Conventional biasing spring 80*a*, 82*a* bias the movable stops 80, 82 against stop tabs 80*b*, 82*b*. The movable stops 80,82 include respective arm portions 81,83 which are connected via an actuating tie link 89 for concurrent movement. A conventional solenoid 90, when actuating, will push, via a plunger link 92, against a pin joint 94 provided by the movable stop 80, and thus rotate the movable stops 80,82 about their respective pins 84,86 in counterclockwise fashion, the links being guided by slot/pin joints 84*a*, 86*a*. The function and actuating sequence of the movable stops 80,82 will be discussed with reference to FIGS. 2 and 3.

Typically, a "common cavity" oven is provided with a removable oven door, i.e., one wherein an upward pull on the door when in a partially open condition, will permit it to slide off a pair of hinges located along the bottom edge of the oven door at opposite lower corners thereof. When the oven door is in a closed condition, it is imperative that the user not be permitted to slide the oven door up off its hinges, even to a slight degree, since during a self-cleaning pyrolytic cycle, the sealing interface of the door relative to the oven cavity could be disturbed, resulting in an unsafe operating condition. Also, the oven door seal must not be disturbed during microwave cooking, since radiation leakage may occur, the door seal acting as a microwave absorber or choke in a manner known in the art. To prevent such upward movement of the oven door when in a closed condition, an oven door lift stop 18 is provided, and is illustrated most clearly in FIGS. 1*a*, 1*b*. It is noted that the side edges of the plate member 12 adjacent to and defining a portion of the channels 16*a*, 17*a* are strengthened by reinforcing tabs 19 bent around and spot-welded onto such side edges. It is to be noted that the structures illustrated in FIGS. 1*a* and 1*b* are present at both channel locations; however, for purposes of illustration, the door lift stop 18 is shown only at the location of slot 17*a*. It can be seen that the door lift stop 18 forms a bridge over the slot 17*a* to effectively preclude upward movement of the keeper 17 (and thus the oven door) when in a closed position and engaged with the associated hook member 22*a*. The hook member 22*a* is free to engage the keeper and can move backwardly into the channel to pull the keeper 17 inwardly, since the door lift stop 18 provides a latch hook slot 18*a*.

Figure 2:
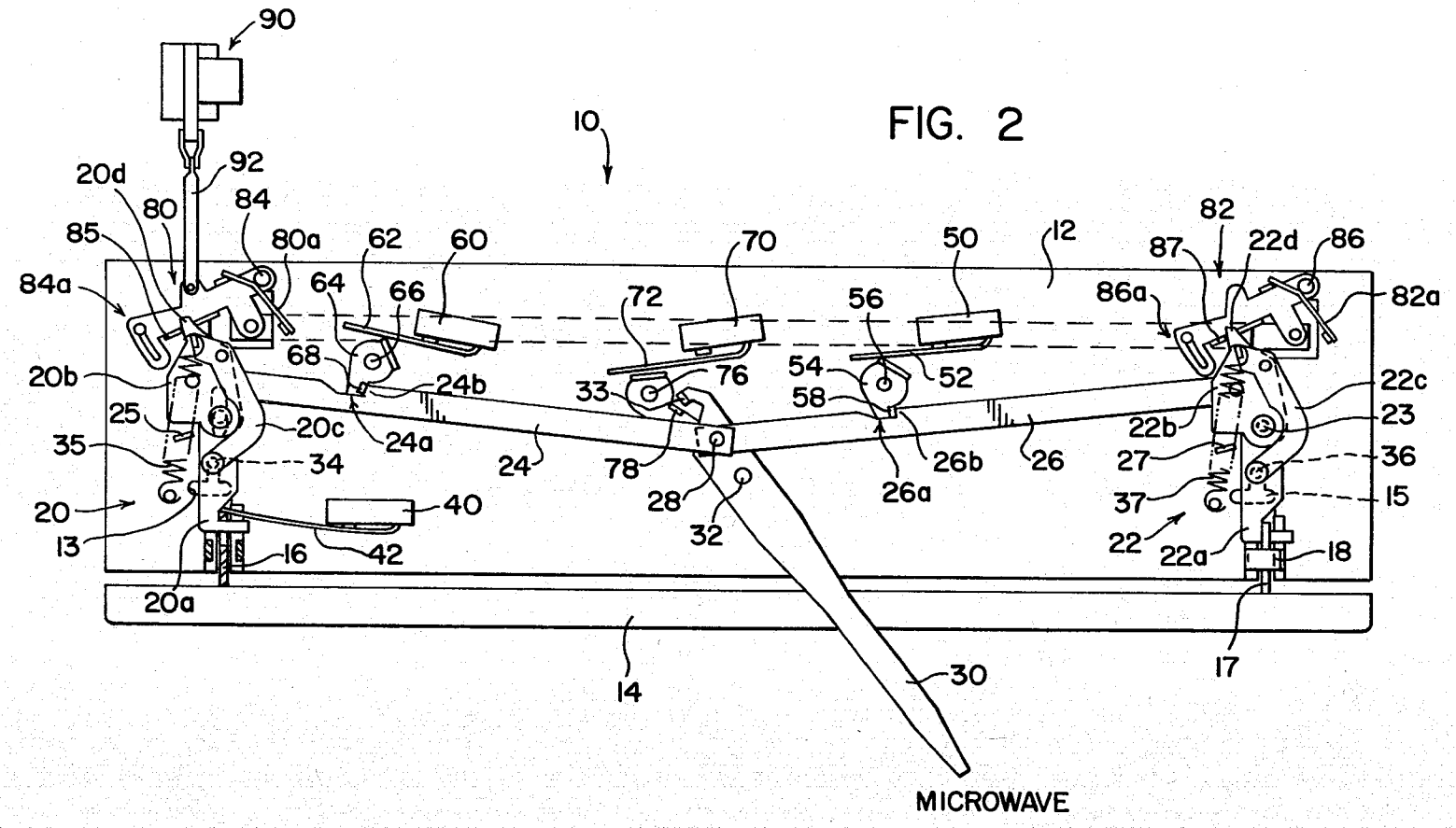
FIG. 2 is a plan view of the latching and locking mechanism illustrated in FIG. 1, the latching and locking mechanism being in a "microwave cooking" condition.

With reference to FIG. 2, the elements of FIG. 1 are illustrated and identified with like reference numerals but some of the elements are in different positions established upon movement of the handle 30 to the microwave position, as illustrated. In such a position, with the door in a closed position and the keepers 16,17 engaged with the hook members 20*a*, 22*a*, the interlock switches 50 and 60 are actuated to permit microwave energization within the oven cavity. It is to be noted that the door monitor microswitch 40 is also in an actuated condition, the monitoring switch actuating arm 42 having been engaged by the leading edge of the keeper 16 as it moved into the channel 16*a*. With the latch and locking mechanism 10 in the position illustrated in FIG. 2, counterclockwise rotation of the lever members 20*b*, 22*b* are limited by the stop tabs 85, 87 provided by the movable stops 80,82, the door lock solenoid 90 being in an unenergized condition. Thus, it can be seen that the handle 30 cannot be moved further to the right (as viewed in FIG. 2) toward the clean position.

With the latch in the microwave position as illustrated in FIG. 2, the user can quickly unlock the oven door by simply moving the handle 30 to the left to re-establish the open position illustrated in FIG. 1, such movement causing counterclockwise rotation of the toggle elements 54,64 to open the switches 50,60 and thus de-energize the microwave source within the oven so that the oven door can be safely opened. In moving the handle 30 between the two positions illustrated in FIGS. 1 and 2, the movement of the latch mechanisms 20,22, and in particular the over and inward movement of the hook members 20*a*, 22*a*, are provided by a sliding-type guide pins 34,36 fixed to the members 20*a*,22*a* and riding in T-shaped latch guide slots 13,15 provided in the frame 12, the pins 34,36 extending through the plate to its other side for engagement with a mechanism embodying present invention to be subsequently discussed.

It is again noted that the mechanisms 20,22 are of the type generally illustrated by earlier-referenced U.S. Pat. No. 4,133,337. If the keepers 16,17 are not in a position to at least partly engage the hook members 20*a*,22*a* as they move rightwardly during a closing motion, the guide pins 34,36 will simply ride back and forth in the upper parts of the "T" slots 13,15. Only when the motion of the hook members to the right is limited by the keepers 16,17 will the guide pins snap back into the leg of the "T" to effect oven door latching.

While such a feature in itself would seem to preclude latching of and locking of the mechanism 10 without proper engagement of the keepers 16,17, it has been found that partial insertion of the keepers 16,17 will suffice to effect movement of the mechanism 10 to a locked condition (FIGS. 2 and 3) without engagement of the hook members 20*a*,22*a* with the keepers. This is one of the potentially unsafe operating conditions that the present invention is intended to preclude.

Figure 3:
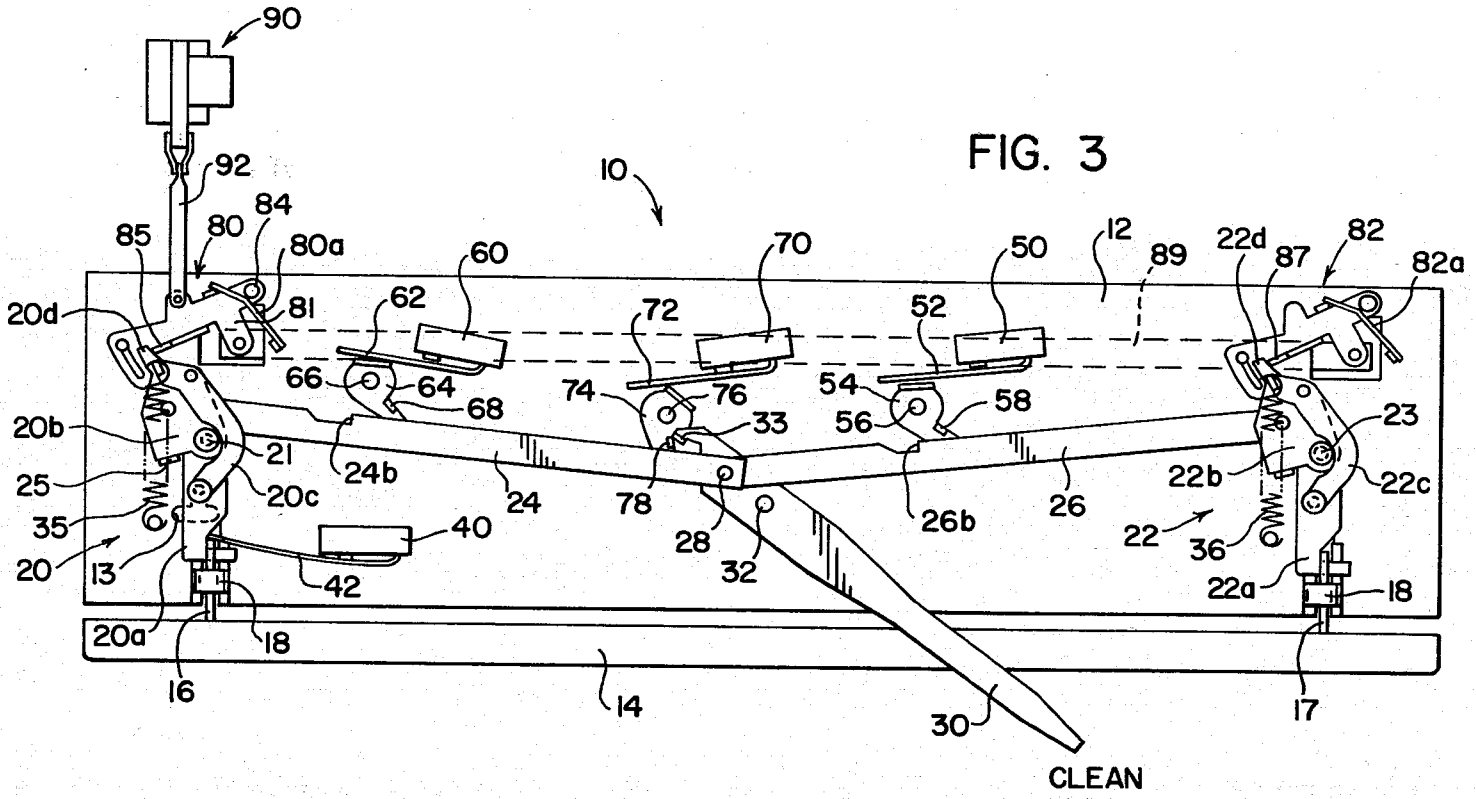
FIG. 3 is a plan view of the latching and locking mechanism illustrated in FIG. 1, the latching and locking mechanism being in an "oven cleaning" condition.

Turning to FIG. 3, the oven door latching and locking mechanism 10 is illustrated in a "clean" position, with the handle 30 moved to a far rightward position. To permit such movement, it is necessary that the solenoid 90 be actuated to move the stop tabs 85,87 out of the way of the rotating lever members 20*b*, 22*b*. With the mechanism in the position illustrated in FIG. 3, the primary and secondary interlock switches 50,60 have been deactuated to disable microwave energization, since the respective cam follower-type tabs 58,68 have slid off their respective cam actuating shoulders 26*b*, 24*b*. In a similar fashion, the toggle element 74 has been rotated to actuate the self-clean enable switch 70 by engagement of the tab 78 with the projection 33 provided by the handle 30. To preclude opening of the oven door when the associated oven cavity is in a highly heated pyrolytic cleaning condition, the oven circuitry energizing the solenoid 90 is disabled (in accordance with sensed oven temperature) so that an associated user actuating push button (not shown) will have no effect on actuation of the solenoid to change the position of the stops 80,82 as illustrated in FIG. 3, nose portions 20*d*, 22*d* of the lever elements 20*b*, 22*b* abutting the stop tabs 85,87 so that clockwise movement of the lever elements 20*b*, 22*b* is precluded (i.e., movement of the handle out of the clean position towards the microwave position or the open position cannot be effected, since energization of the solenoid is necessary and such energization has been precluded by circuit disabling).

With reference to FIGS. 1, 2, and 3, while the illustrated mechanisms and their operations noted above are known in the art, an understanding of such mechanisms is necessary to fully understand and appreciate the present invention that will now be discussed. It has been shown that safe operation of the associated oven is dependent essentially on the movement of the mechanism 10 and not necessarily on the proper position of the keepers 16,17 during a closing motion of the mechanism 10. Thus, it is absolutely imperative that the linkage not be permitted to move to the microwave position or the clean position without proper engagement of the hook elements 20*a*, 22*a* with the associated keepers 16,17.

With reference to FIGS. 4, 5, and 6, a structure incorporating the present invention is illustrated, such structure precluding movement of the handle 30 and the associated linkage mechanism into a microwave or clean position without proper engagement of the associated keepers 16,17. It is noted that the mechanism illustrated in FIGS. 4, 5, and 6 could be provided for each of the keepers 16 and 17. However, for purposes of illustration, only one mechanism is illustrated in association with the keeper 16.

In accordance with the present invention, a linear slide stop 100 for inhibiting and interfering with the movement of a guide pin 34, and thus the latch hook member 20*a*, is provided on the underside of the frame 12 opposite the latching mechanism 20 (see FIGS. 1 through 3). The slide stop 100 slidingly engages and rides on a pair of spaced-apart guide rivets 106,108 which are generally aligned along a line parallel to the extent of the channel 16*a*. A biasing spring 104 anchored at one end to the frame 12 and at the other end to an end portion or other suitable portion of the slide stop 100 biases the slide at and toward the position illustrated in FIG. 4. When the slide is in the position illustrated in FIG. 4, a blocking edge 101 of the slide stop 100 extends over and across a portion of the T-slot 13, as illustrated, to block and interfere with the movement of the pin 34 out of its position as illustrated in FIG. 4. It can be seen that an attempt by the user to move the latch handle 30 towards the microwave or clean position so as to energize interlock switches 50, 60, or 70 when the oven door is in an open or partially open condition is advantageously precluded.

To permit movement of the latch handle to the microwave or clean position, the keeper 16 must be inserted into the channel 16*a*, wherein an aperture or eyeletlike opening 16*b* in the keeper can receive the hooked end of the latch member 20*a*. In moving the keeper 16 into the channel 16*a*, the leading or forward edge of the keeper will abut a fingerlike slide actuating projection 102 (also see FIG. 1) that extends into the channel 16*a*. The projection 102 engages the forward edge of the keeper 16 and moves back against the biasing spring 104 gradually (see FIG. 4) towards the position illustrated in FIG. 6.

With reference to FIG. 5, it can be seen that when the slide mechanism 100 has moved back to a position wherein the hook can engage the eyelet aperture 16*b*, the pin 34 is then free to move rightwardly to effect a locking movement of the latch. As illustrated in FIG. 5, movement of the handle 30 allows the biasing springs 35,37 (see FIG. 1), which are of the over-center actuating type, to pull the latching member 20*a* rearwardly to slide on the pin 21 via the slot 21*a*. The position of the slide stop 100 as shown in FIG. 6 is the position it takes when the handle is at the microwave or clean position (oven door closed).

In summary, it can be seen that the linear slide stop 100 of the present invention functions to inhibit and interfere with the movement of the latch member 20*a* towards the location of the keeper 16 when the oven door is in a closed position. In so doing, the safety linear slide stop 100 precludes actuation of the self-clean enable switch 70 and the associated microwave primary and secondary interlock switches 50,60 so as to ensure that an unsafe operating condition cannot be established. Only when the oven door is properly closed (keeper 16 is in a condition for latching) will the slide locking edge 101 be moved out of position to enable the pin 34 to track the T-slot 13 for movement of the latch member 20*a* towards the keeper 16 for a latching and locking operation.

Although the preferred embodiment of this invention has been shown and described, it should be understood that various modifications and rearrangements of parts may be resorted to without departing from the scope of the invention as disclosed and claimed herein.

What is claimed is:

1. A mechanism for inhibiting the locking movement of a hooklike oven door latch member engageable with a keeper fixed to an associated oven door, the latch member being movable toward the keeper and lockably engageable with it only when the oven door is closed to a predetermined degree, the inhibiting mechanism comprising:

a stop member movable between two positions; and a biasing means for maintaining the stop member at one position, the stop member at said one position blocking and interfering with the movement of the latch member toward the location of the keeper at its closed oven door position, the keeper engaging with the stop member and moving it against the force of said biasing means toward said other position into a non-blocking and non-interfering position relative to the latch member movement when the keeper is at said location, the latch member then being free to move toward and lockably engage the keeper, the stop member being generally linearly movable between said positions and a portion of the latch member being generally linearly movable toward the keeper, said linear movement of the latch member portion being along a line perpendicular to the line along which the stop member linearly moves, the stop member being slidably mounted to a frame means supporting the latch member, the frame means including a slot having a portion extending toward said location of the keeper, said latch member portion including a pin riding in said slot, the stop member at said one end position blocking said slot to retain the pin at the end of said slot portion farthest from said location of the keeper.

2. A mechanism for inhibiting the locking movement of a hooklike oven door latch member engageable with a keeper fixed to an associated oven door, the latch member being movable toward the keeper and lockably engageable with it only when the oven door is closed to a predetermined degree, the latch member being mounted to a frame means, the inhibiting mechanism comprising:

a stop member including a closed ended linear slot, the slot slidably receiving a pair of spaced about parallel rivets of a diameter slightly less than the width of the slot, the rivets being fixed to the frame and extending perpendicularly therefrom, the distance between the rivets being less than the length of the slot wherein the stop member is linearly slidable between two end positions; and a spring connected between the frame and the stop means, the spring biasing and maintaining the stop member at one end position, the stop member at said one end position blocking and interfering with the movement of the latch member toward the location of the keeper at its closed oven door position, the stop member preventing substantial movement of the latch member toward said location, the keeper engaging with the stop member and moving it against the biasing force of said spring toward said other end position into a non-blocking and non-interfering position relative to the latch member movement when the keeper is at said location, the latch member then being free to move toward and lockably engage the keeper, the frame means being a generally flat plate having a channel open at one end along a forward edge of the plate, the keeper being a bladelike member having a leading edge received in the channel, the stop member including a fingerlike projection extending into the general area of the channel and transverse to it, the leading edge of the keeper engaging and pushing the fingerlike projection inwardly toward the closed end of the channel as the keeper enters and moves into the channel, the latch member being located adjacent the channel on one side of the plate, the stop member being located adjacent the channel on the other side of the plate, a pin member fixed to the latch member projecting through an aperture in the plate, the stop member in said one position engaging the pin and blocking its movement as the latch member moves toward said location of the keeper.

* * * * *